US008191209B2

(12) United States Patent
Wolfgang

(10) Patent No.: US 8,191,209 B2
(45) Date of Patent: Jun. 5, 2012

(54) CLASP FOR A WRISTBAND

(75) Inventor: Sima Wolfgang, Keutschach (AT)

(73) Assignee: Hirsch Armbänder GmbH, Klagenfurt (AT)

( * ) Notice: Subject to any disclaimer, the term of this patent is extended or adjusted under 35 U.S.C. 154(b) by 682 days.

(21) Appl. No.: 12/240,489

(22) Filed: Sep. 29, 2008

(65) Prior Publication Data

US 2009/0083949 A1 Apr. 2, 2009

(30) Foreign Application Priority Data

Oct. 1, 2007 (AT) ..... GM585/2007

(51) Int. Cl.
*A44C 5/14* (2006.01)
*A44C 5/16* (2006.01)

(52) U.S. Cl. ..... 24/265 WS; 24/304; 24/906; 224/180

(58) Field of Classification Search ..... 24/304, 24/265 WS, 265 EC, 265 BC, 906; 224/164, 224/180
See application file for complete search history.

(56) References Cited

U.S. PATENT DOCUMENTS 3,929,265 A 12/1975 Pyne et al.
5,056,197 A * 10/1991 Cohen ..... 24/304
6,405,908 B2 * 6/2002 Hood et al. ..... 24/265 BC

FOREIGN PATENT DOCUMENTS

| | | |
|---|---|---|
| DE | 78 13 904 U1 | 9/1978 |
| DE | 78 27 436 U1 | 3/1979 |
| FR | 1 546 737 A | 11/1968 |
| GB | 379023 | 8/1932 |
| GB | 404 811 | 1/1934 |

* cited by examiner

*Primary Examiner* — Robert J Sandy
(74) *Attorney, Agent, or Firm* — Dickstein Shapiro LLP

(57) ABSTRACT

A clasp (3) for a wristband (1) including a flap (4) attachable to the wristband (1) or formed integrally with the wristband, which flap is wrappable around a fastening element of a counterpart and exhibits an end region (6) which is attachable to an initial region (5) of the flap (4) via a snap connection or latch connection, respectively, for clasping the fastening element, with a loop being formed. The snap connection or latch connection, respectively, is designed so as to be detachable and the end region (6) of the flap (4) and/or the initial region (5) of the flap (4)—which can be contacted with the end region (6)—is/are provided with an adhesive (15) on its or their inside(s) which is covered with a detachable film (16), wherein, however, interlocking parts (11, 12) of the snap connection or latch connection, respectively, are free from adhesive.

9 Claims, 5 Drawing Sheets

CLASP FOR A WRISTBAND

BACKGROUND OF THE INVENTION

1. Field of the Invention

The invention relates to a clasp for a wristband, in particular to a clasp for connecting a watchband to a watch case, wherein a flap attachable to the wristband or formed integrally with the wristband is wrappable around a fastening element of a counterpart, in particular around a pin attached to the watch case, for example a spring pin, and wherein an end region of the flap is attachable to an initial region of the flap via a snap connection or latch connection, respectively, for clasping the fastening element, with a loop being formed.

2. Description of the Related Art

A clasp of this type is known from U.S. Pat. No. 3,929,265 A. Said clasp also serves for the connection of a band to a watch case, wherein an anchoring pin inserted in a watch case at the flanges thereof is enclosed by the clasp. For the purpose of firmly holding the band, the snap connection or latch connection, respectively, is designed on the watch case such that opening thereof is possible only by destroying the elements of the snap connection or latch connection, respectively, so that the band will have to be replaced by a new one in case the snap connection or latch connection, respectively, is opened. Renewed closing of the snap connection or latch connection, respectively, would produce no reliable support of the wristband first used on the watch case.

When buying a watchband, a customer often wishes to try several watchbands on his or her watch in order to be able to choose a watchband perfectly adequate with regard to the design and/or the colour and/or the dimensions, respectively. Thus, the watchband should be suitable for being tentatively attached to the watch and, in case a different watchband is chosen, the watchband tentatively attached to the watch should be suitable for being removed from the watch and for being used in mint condition for a different customer, i.e., no traces of the tentative attachment to a watch case on the watchband should be visible.

SUMMARY OF THE INVENTION

According to the invention, said object is achieved by a combination of features which is characterized in that the snap connection or latch connection, respectively, is designed so as to be detachable and the end region of the flap and/or the initial region of the flap—which can be contacted with the end region—is/are provided with an adhesive on its or their inside (s) which is covered with a detachable film, wherein, however, interlocking parts of the snap connection or latch connection, respectively, are free from adhesive.

Thus, it is possible to close the clasp by latching or locking into place the snap connection or latch connection, respectively, so that the watchband is attached to the watch case, with the detachable film still being present between the surfaces of the end region and the initial region of the flap, which surfaces abut each other after the closure of the snap connection or latch connection, respectively.

After the tentative attachment of the watchband to the watch case, the detachable snap connection or latch connection, respectively, can be reopened and the watchband can again be made available in mint condition.

For easier handling of the detachable film and for making sure that said film is still present, the clasp is characterized in that the detachable film is provided with a handle projecting beyond the width of the wristband.

Preferably, the detachable film is provided with recesses for the passage of elements of the snap connection or latch connection, respectively, whereby neat covering of the entire adherend becomes possible.

The snap connection or latch connection, respectively, may be designed as a push-button connection or may also exhibit elastic hooks which are insertable in recesses while engaging behind the edges of the recesses.

Preferably, the flap is made of a flexible synthetic material, with the flap suitably being designed thinner in the area with which it clasps the fastening element than in the other areas.

In order to design a wristband in an optically particularly appealing manner, the clasp is manufactured in such a way that the wristband covers the flap outwardly.

An easily manufacturable embodiment is characterized in that the snap connection or latch connection, respectively, comprises two elements supporting the interlocking parts of the snap connection or latch connection, respectively, with one element being attached to the end region of the flap and one element being attached to the initial region of the flap and being connected to the respective region in a non-detachable manner.

BRIEF DESCRIPTION OF THE DRAWINGS

Below, the invention is illustrated in further detail by way of an exemplary embodiment depicted in the drawing.

DETAILED DESCRIPTION OF THE PREFERRED EMBODIMENTS

Figure 1:
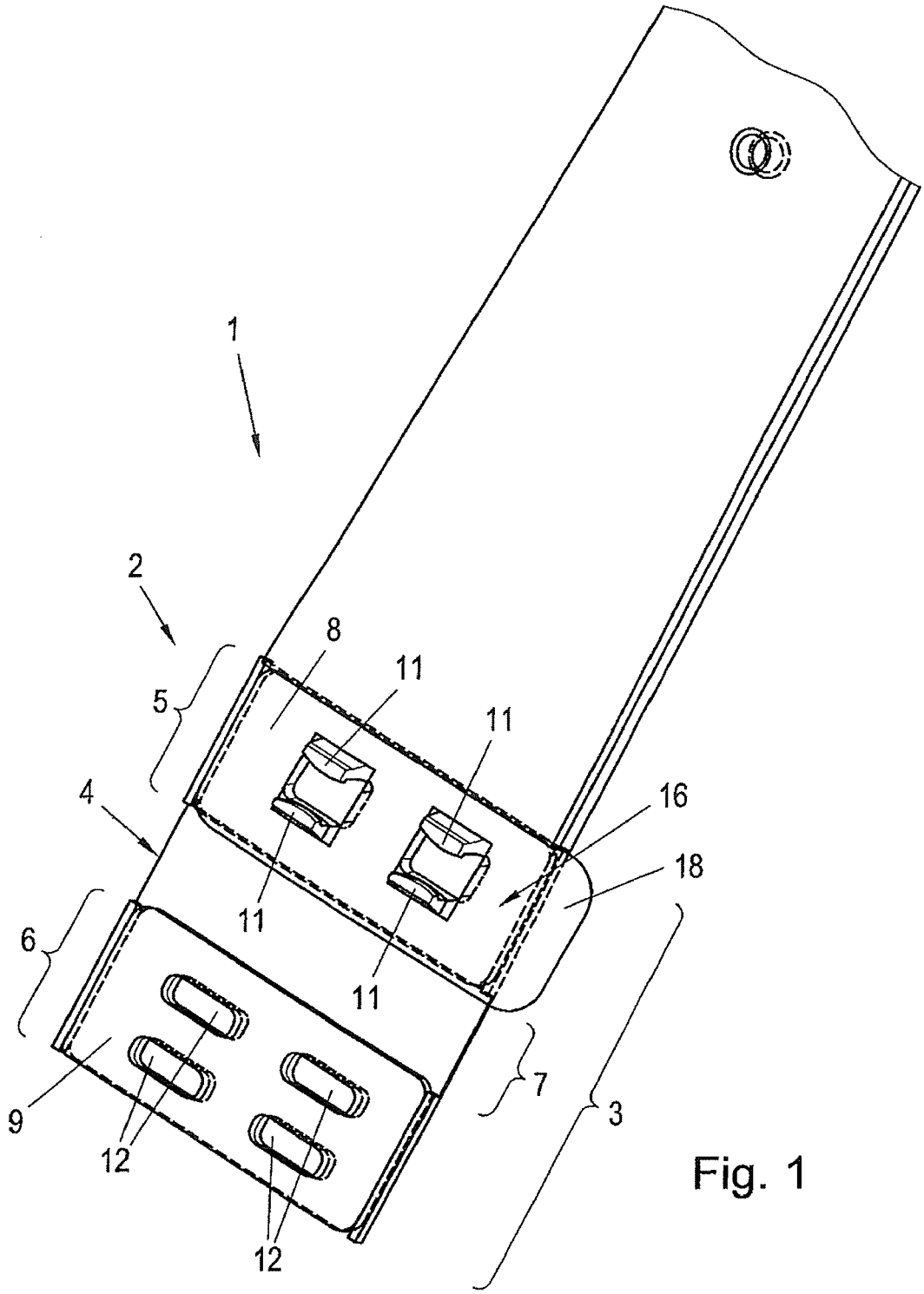
FIG. 1 shows in oblique view the end of a watchband with an opened clasp.
Figure 2:
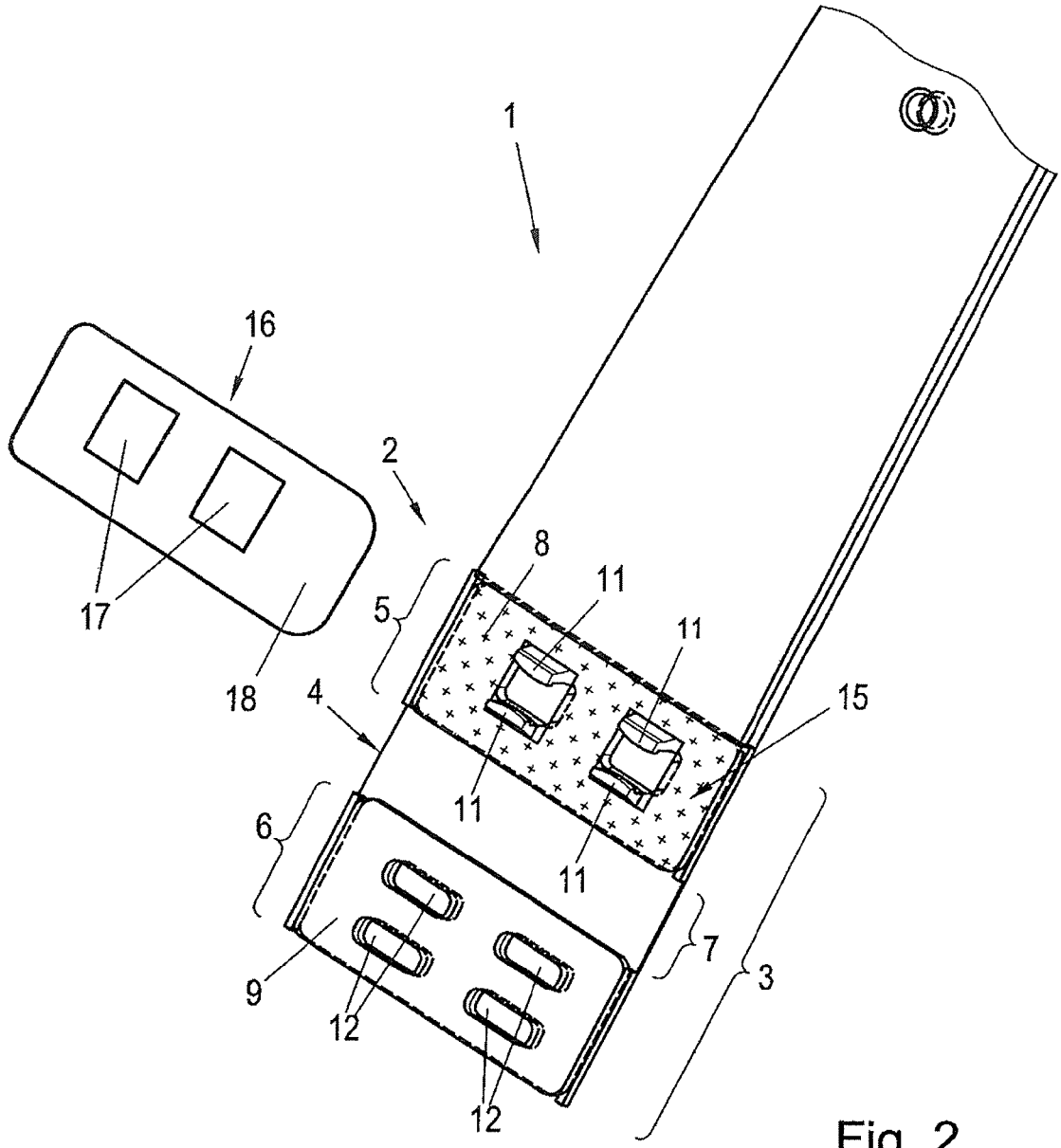
FIG. 2 is an exploded view of an analogous illustration.

In FIG. 1, the end region 2 of a watchband 1 is depicted, which end region comprises a clasp 3 which is formed by a flap 4 preferably designed integrally with the watchband. Said flap 4 is thinner than the watchband 1 and exhibits an initial region 5 and an end region 6 as well as a very flexible intermediate region 7 located therebetween. Said flap 4 can be wrapped around a fastening pin, such as, e.g., a spring pin, arranged at the flanges of a watch case, whereby the intermediate region 7 can be wrapped around such a pin.

Both the initial and the end regions 5, 6 are provided with two matching elements 8, 9, which support parts 11, 12—as described below—of a snap connection or latch connection, respectively, with said elements 8, 9 being designed as parts glued to said regions 5, 6 of the flap 4. However, they could also be designed integrally with the flap 4 and thus also with the watchband 1.

The element 8 arranged in the initial region 5 comprises two pairs of hooks 11 resilient against each other which are insertable in recesses 12 corresponding to said hooks 11 and located on the element 9 provided in the end region 6 so that the undercuts 13 of the hooks 11 can be passed through those recesses 12 and the hooks 11 project into cavities 14 behind those recesses 12, whereby support is produced by the fact that the hooks 11 spring apart. However, the hooks 11 are designed in a rounded manner so that the snap connection formed by the hooks 11 and recesses 12 becomes possible again by detaching the end region 6 from the initial region 5 of the flap 4 without causing damage to the hooks 11 and recesses 12, respectively.

An adhesive 15 covered by a detachable film 16 is applied to at least one side of the elements 8, 9 of the faces which abut each other if the clasp 3 is closed. Said detachable film 16 has openings 17 through which the elastic hooks 11 project. The detachable film 16 is provided with a handle 18 which projects beyond the width 1 of the watchband so that the detachable film 16 can be removed when necessary from the surface provided with the adhesive 15.

Figure 3:
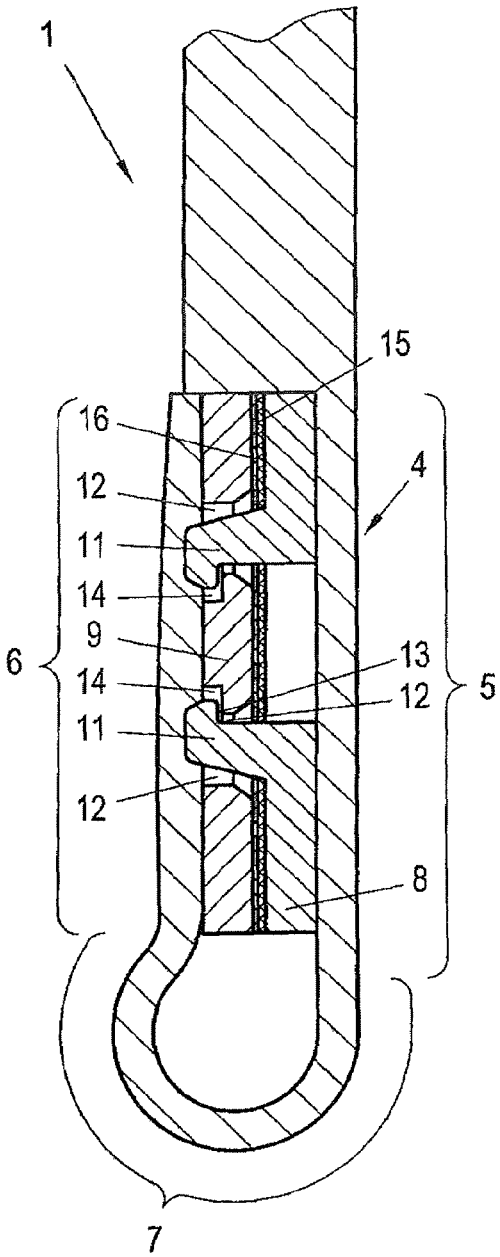
FIG. 3 shows a sectional view of the clasp in the closed state.

In FIG. 3, the closed state of the clasp 3 is illustrated in sectional view and it is noticeable that a non-detachable connection of the elements 8, 9 is avoided as a result of the intermediate position of the detachable film 16 between the adhesive 15 and the element 9 lying on top of the detachable film 16. Thereby, it is possible to attach a watchband 1 of such kind to a watch on a trial basis and to remove it from the watch if it is unappealing.

Figure 5:
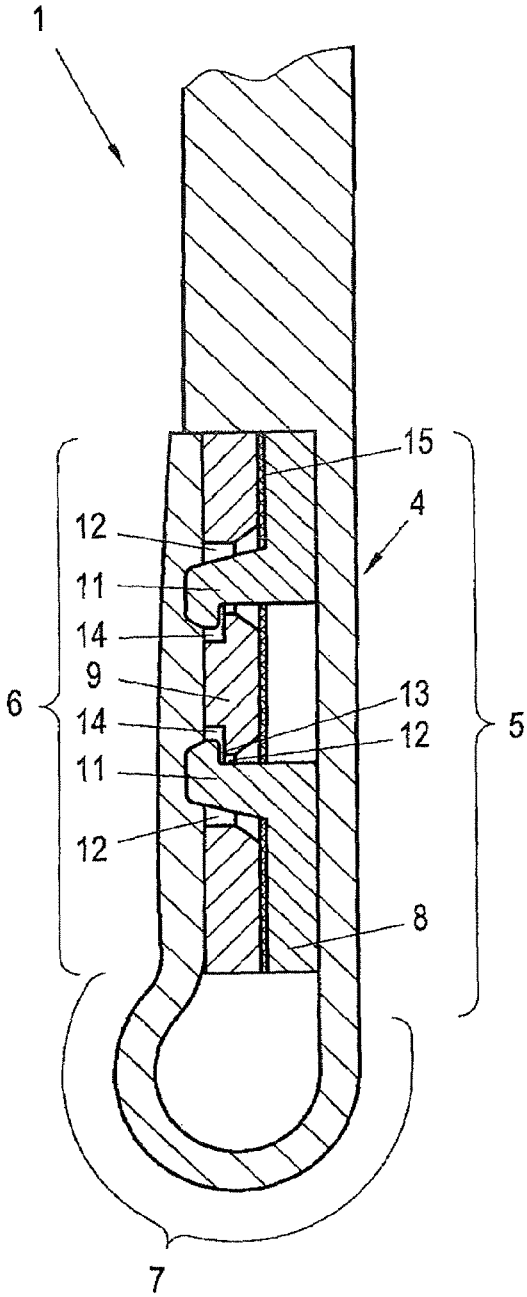
FIG. 5 shows the clasp in the closed state after the detachable film has been removed.
Figure 4:
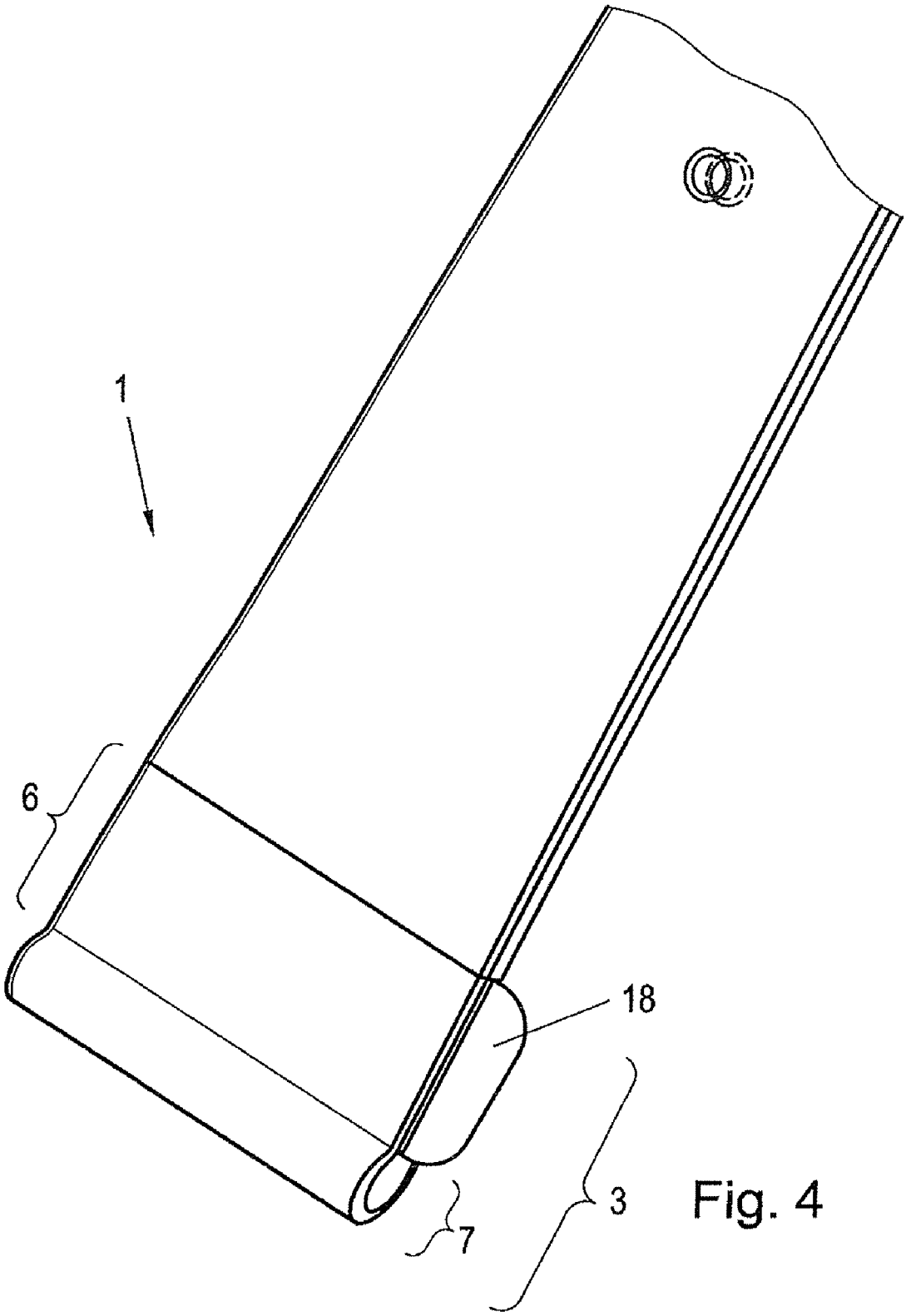
FIG. 4 is an oblique view illustration of the clasp in the closed state

If, however, the watchband 1 is to be attached to the watch in a non-detachable manner, the detachable film 16 is removed and the clasp 3 is closed, whereby, as illustrated in FIG. 5, the adhesive 15 located between the elements 8 and 9 will then permanently connect said elements to each other.

Figure 6:
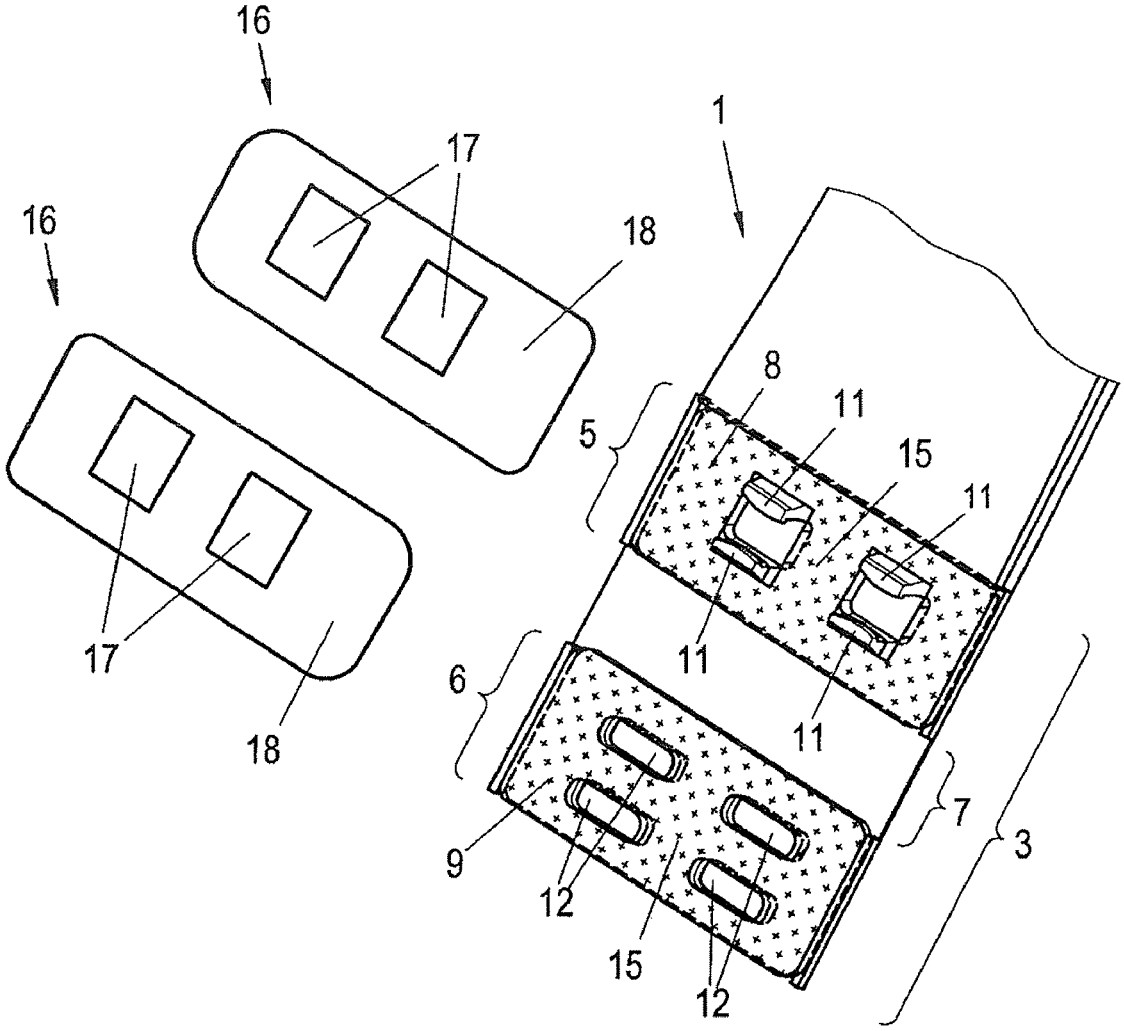
FIG. 6 depicts a variant in an illustration analogous to FIG. 1.

According to the embodiment illustrated in FIG. 6, both elements 8 and 9 are coated with adhesive 15 on the surfaces contacting each other and both surfaces provided with adhesive are provided with one detachable film 16 each in order to enable, in turn, the detachment of the watchband 1 from the watch.

The invention is not limited to the depicted exemplary embodiment but may be modified in various regards. The snap connection may be designed in any fashion, for example, pushbuttons may be provided instead of hooks 11. Furthermore, the invention can be used for wristbands of any kind, for example, for the connection of a wristband to a piece of jewelery etc.

What is claimed is:

1. A clasp (3) for a wristband (1), in particular a clasp (3) for connecting a watchband (1) to a watch case, wherein a flap (4) attachable to the wristband (1) or formed integrally with the wristband is wrappable around a fastening element of a counterpart, in particular around a pin attached to the watch case, for example a spring pin, and wherein an end region (6) of the flap (4) is attachable to an initial region (5) of the flap (4) via a snap connection or latch connection, respectively, for clasping the fastening element, with a loop being formed, characterized in that the snap connection or latch connection, respectively, is designed so as to be detachable and the end region (6) of the flap (4) and/or the initial region (5) of the flap (4), which can be contacted with the end region (6), is/are provided with an adhesive (15) on its or their inside(s) which is covered with a detachable film (16), and wherein interlocking parts (11, 12) of the snap connection or latch connection, respectively, are free from adhesive, and wherein the inside of the end region (6) contacts the inside of the initial region (5) when the interlocking parts (11, 12) of the snap connection are engaged.

2. A clasp (3) according to claim 1, wherein the detachable film (16) is provided with a handle (18) projecting beyond the width of the wristband (1).

3. A clasp (3) according to claim 1, wherein the detachable film (16) is provided with recesses (17) for the passage of the parts (11, 12) of the snap connection or latch connection, respectively.

4. A clasp (3) according to claim 1, wherein the snap connection or latch connection, respectively, is designed as a push-button connection.

5. A clasp (3) according to claim 1, wherein the snap connection or latch connection, respectively, exhibits elastic hooks (11) which are insertable in recesses (12) while engaging behind the edges of the recesses (12).

6. A clasp (3) according to claim 1, wherein the flap (4) is made of a flexible synthetic material.

7. A clasp (3) according to claim 1, wherein the flap (4) is designed thinner in an area with which the flap clasps the fastening element than in other areas.

8. A clasp (3) according to claim 1, wherein, when worn by a user, the wristband (1) covers the flap (4).

9. A clasp (3) according to claim 1, wherein the snap connection or latch connection, respectively, comprises two elements (8, 9) supporting the interlocking parts (11, 12) of the snap connection or latch connection, respectively, with one of the elements (9) being attached to the end region (6) of the flap (4) and the other one of the elements (8) being attached to the initial region (5) of the flap (4) and being connected to the respective end region (6) or initial region (5) in a non-detachable manner.

* * * * *